United States Patent [19]

Coli et al.

[11] Patent Number: 4,566,779

[45] Date of Patent: Jan. 28, 1986

[54] REPRODUCING MACHINE HAVING A REMOVABLE PROCESS UNIT

[75] Inventors: Giuseppe Coli, Pavone; Luciano Rattin, Ivrea, both of Italy

[73] Assignee: Ing. C. Olivetti & C., S.p.A., Turin, Italy

[21] Appl. No.: 577,357

[22] Filed: Feb. 6, 1984

[30] Foreign Application Priority Data

Feb. 10, 1983 [IT] Italy ..... 67147 A/83

[51] Int. Cl.[4] ..... G03G 15/00

[52] U.S. Cl. ..... 355/3 R; 355/3 BE; 355/3 DD; 355/16

[58] Field of Search ..... 355/3 R, 3 BE, 3 DR, 355/3 DD, 3 FU, 16, 14 FU; 219/216, 388, 469, 470; 198/813, 814

[56] References Cited

U.S. PATENT DOCUMENTS

| | | | |
|---|---|---|---|
| 3,846,021 | 11/1974 | Vola | 355/16 |
| 4,243,869 | 1/1981 | Scribner | 219/216 |
| 4,264,182 | 4/1981 | Mitchell | 355/16 X |
| 4,373,468 | 2/1983 | Suda et al. | 355/3 DD X |
| 4,403,851 | 9/1983 | Yanagawa | 355/3 BE X |
| 4,432,632 | 2/1984 | Yokota | 355/3 BE X |
| 4,462,677 | 7/1984 | Onoda | 355/3 R |

FOREIGN PATENT DOCUMENTS

| | | | |
|---|---|---|---|
| 0202577 | 12/1982 | Japan | 355/14 FU |

*Primary Examiner*—A. T. Grimley
*Assistant Examiner*—J. Pendegrass
*Attorney, Agent, or Firm*—Banner, Birch, McKie & Beckett

[57] ABSTRACT

In a reproducing machine the photoconductive member, in the form of an endless belt, and the developing station are carried in a container or cartridge removably mounted on the machine. The photoconductive belt surrounds a support structure integral with the cartridge. The support structure includes a resilient portion engaging the photoconductive belt to keep it under tension around the structure. A magnetic belt of tubular form, fixed within the cartridge, is surrounded by a sleeve of non-magnetic material. The magnetic belt is so magnetized as to form a regular distribution of pairs of magnetic poles of opposite polarity. The toner adheres by magnetic action on the external surface of the sleeve to form a magnetic brush of the developing station.

3 Claims, 4 Drawing Figures

REPRODUCING MACHINE HAVING A REMOVABLE PROCESS UNIT

BACKGROUND OF THE INVENTION

The present invention relates to an electrophotographic copying machine having a removable process unit and in particular to a copying machine comprising a structural housing, means in said housing for supporting an original, a scanning device for optically scanning said original, a process unit including a photoconductive member, a toner supply means and a developing device, said process unit being conditioned by said scanning device for forming a latent image of said original on said photoconductive member, said developing device carrying the toner supplied by said supplying means to develop said latent image.

In a known copying machine a process unit is removably mounted on the machine and is provided with a photoconductive endless belt wound around a pair of rollers rotatably mounted on an auxiliary frame carried by the process unit. The photoconductive belt is tensioned on the rollers by a pair of springs urging against the bearings of one of the rollers.

However, when the exhausted photoconductor is to be replaced, the auxiliary frame must be separated from the process unit and the tension applied to the belt must be released, resulting in complex operations and in waste of time.

SUMMARY OF THE INVENTION

It is an object of the present invention to provide a reproduction machine including a process unit of simple construction and adapted to be easily replaced when the photoconductor is exhausted.

According to the invention, we now provide a reproduction machine having a replaceable process unit, the process unit including a support structure for supporting the photoconductive member in a closed loop arrangement therearound, having a substantially flattened form and upper and lower faces rigidly connected to and parallel to each other and to the original. The photoconductive member forms over the upper face a planar surface on which the latent image is formed.

The structure also comprises drive means for advancing the member at one end of the flattened structure and a resilient channel-shaped portion integral with the structure and placed opposite with respect to the driving means to tension the member around the structure. Also included is means for removably mounting the cartridge in the housing together with the process unit so that it can be replaced when the supply means has exhausted the toner.

BRIEF DESCRIPTION OF THE DRAWINGS

The invention will now be described purely by way of non-limiting example with reference to the appended drawings, in which.

DETAILED DESCRIPTION OF A PREFERRED EMBODIMENT

Figure 1:
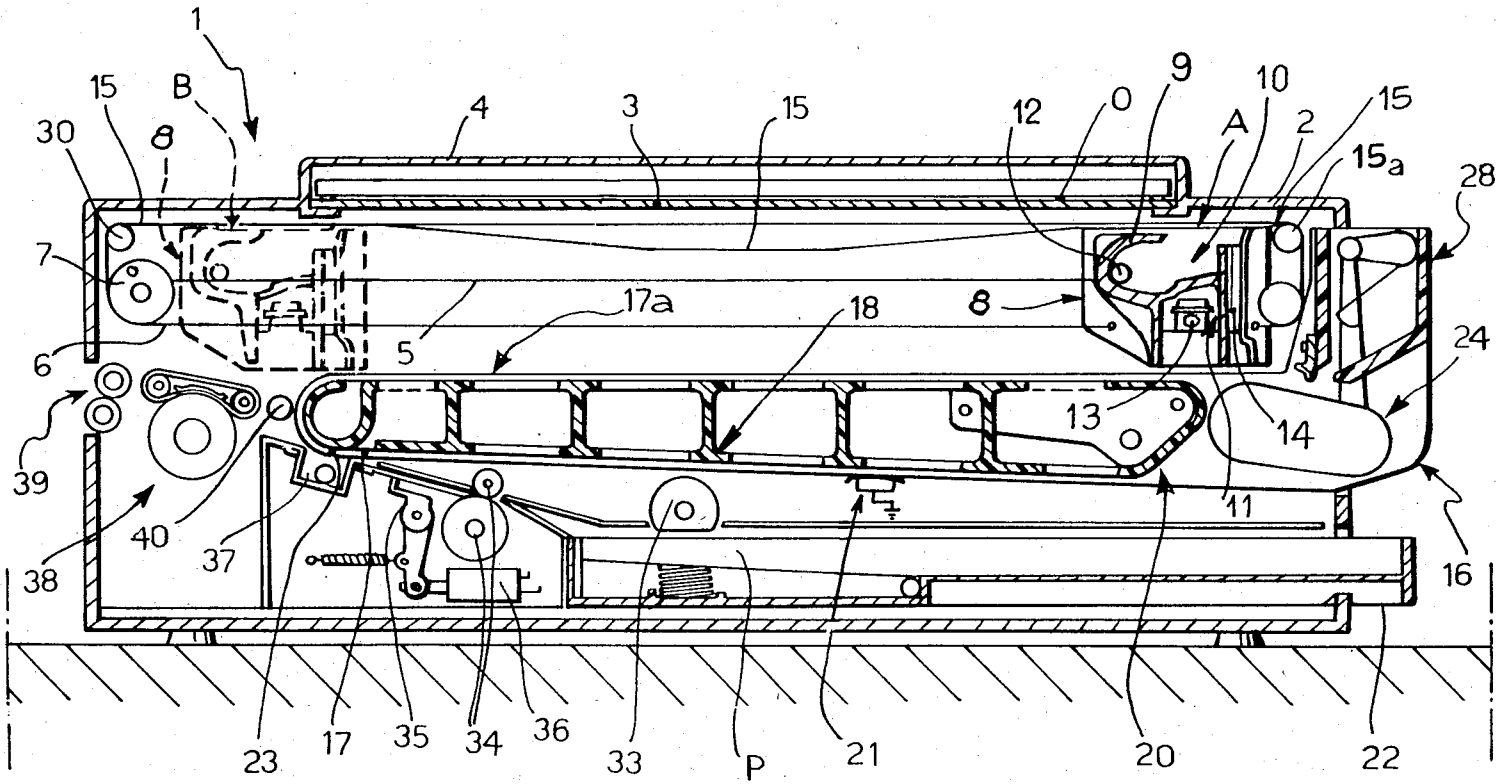
FIG. 1 is a vertical sectional view through the middle of a copying machine according to the invention.

The description below relates to a copying machine that uses ordinary sheets of paper as the reproduction substrates. In the claims which follow the term "substrate" is however intended to refer to any laminar element of paper, plastics, celluloid, metal etc., onto which a material can be transferred in powder, paste or liquid form acting as a toner and which can be made to adhere permanently to the substrate itself.

In the drawing reference 1 generally indicates an electrophotographic copying machine which is contained in a structural housing 2 of compact form.

The upper part of the housing 2 has a fixed reading plane formed by a transparent sheet of glass 3 on which an original O to be reproduced is located and held firm by a blanket 4.

A device, generally indicated 8, for scanning the original O is movable under the action of a belt transmission 6 rotated by a drive pulley 7, along a pair of slide guides 5 carried by the housing on two opposite sides of the reading plane 3.

The scanning device 8 includes a shaped support body 9 of elongate form with longitudinal dimensions substantially corresponding to the transverse dimensions of the reading plane 3 on which the originals O are disposed.

The support body 9 has two longitudinal cavities indicated 10 and 11 respectively.

The first cavity, which opens towards the reading plane 3, has mirrored reflecting walls shaped so as to project, towards the glass 3, that is, towards the original O, light generated by a source 12 constituted by a linear halogen lamp extending longitudinally within the cavity 10.

Within the second cavity 11, which opens substantially in the opposite direction from the first cavity 10, is a corona discharge source 13 of any known type.

The body 9 may be constituted by a single profiled aluminium section or by an element of electrically insulating material which is metallized in correspondence with the walls of the cavity 10 and the cavity 11. The metallization of the walls of the cavity 10 is intended to give these walls reflecting characteristics while the metallization of the walls of the cavity 11 is intended to act as an earthing casing for the corona discharge source 13.

The electrically insulating material used for the body 9 may be a sintered alumina or a glass or plastics material having resistance to heat. A linear objective indicated 14 is constituted, for example, by an array of optical fibres fixed to the body 9 and oriented in a plane normal to the reading plane 3.

The arrangement is such that rotation of the drive pulley 7 by means of a drive motor, constituted preferably by a d.c. motor or a stepping motor, makes it possible to move the scanning device 8 across the reading plane 3 between a starting position illustrated in full outline and indicated A in FIG. 1 and an end of stroke position illustrated in broken outline and indicated B in the same Figure.

The device 8 can be returned to its starting position A by reversal of the sense of rotation of the motor driving the pulley 7. Preferably, the motor driving the pulley 7 is rotated at a higher speed during the return travel than that used during the scanning movement so as to reduce the time required to return the device 8 to its starting position A.

Reference 15 indicates two belt blinds which can be rolled up and are of a material opaque to the light emitted by the lamp 12, each belt being connected at one end to the body 9 along one of the longitudinal edges of the cavity 10 and, at its opposite end, wound on a respective collecting roller 15*a*.

Reference 16 indicates a container or cartridge, made of a plastics material, that can be removed independently from the housing 2 for the purposes of replacement.

Within the container 16 is a unit for forming latent images that comprises a band 17 of photosensitive material formed into a closed loop on a support structure generally indicated 18 integral with the cartridge 16.

The photosensitive band 17 is constituted by a flexible substrate of metal film or metallized plastics material on which a layer 17*a* of photoconductive material of organic or zinc oxide type is deposited in known manner.

The closed loop configuration is achieved by connecting the ends of a length of the band by gluing or by a joining element.

The layer of photoconductive material 17*a* has a transverse extent substantially corresponding to the extent of the linear objective 14, that is, the transverse extent of the reading plane 3.

The flexible band 17 of metal or metallized plastic however has a slightly greater transverse dimension permitting the band 17 to be provided with two rings of aperture not shown, which are located adjacent the side edges of the band 17 and enable the band to be driven by a pair of sprockets 20.

A bare metal strip is normally also provided along the extreme edges of the band 17 to earth the band via a sliding contact schematically indicated 21.

The support structure 18 is constituted by a single piece of rigid plastics material provided with numerous apertures to reduce its weight.

The support structure 18 has a generally flattened form with a perfectly flat upper face and a substantially flat lower face. The disposition of the band 17 around the structure 18 is thus such that the band 17 can be seen to be composed of an upper pass facing the reading plane 3 and parallel thereto, and a lower pass facing a cassette 22 located beneath the structure 18 and containing a supply of sheets of paper or like material P intended to act as reproduction substrates.

The cassette 22 can be removed from the housing 2 so as to allow a new supply of sheets P to be introduced when the preceding supply has been exhausted.

The surface of the support structure 18 facing the band 17 is not continuous due to the presence of the said weight reducing apertures. The dimensions of these apertures are however selected so as to ensure the planar nature of the two horizontal passes of the band 17.

Preferably the outer surface of the support structure 18 is metallized and connected to earth in order to discharge the triboelectric charges caused by friction during movement of the band.

This movement is effected by the sprockets 20 which, in the embodiment illustrated, are located at the end of the support structure 18 adjacent the end of the reading plane 3 corresponding to the starting position A of the scanning device 8.

The sprockets 20 are rotatably mounted on the support structure 18 in the container 16 which, as indicated above, is removable from the housing 2.

In order to drive the sprockets 20 drive means (not illustrated) are provided and these drive means have disengageable coupling elements such as 20*a* for snap engaging the sprockets 20 when the container 16 is introduced into the housing 2.

At the opposite end with respect to the sprockets 20, the support structure 18 has a channel-shaped part 23 which is resiliently yieldable and is oriented so as not to impede the advancing movement of the band 17, this movement in the embodiment illustrated, being in a clockwise sense.

The resilience of the shaped part 23 allows the band 17 to be kept under slight tension and also compensates for any manufacturing tolerances or stretching of the band 17 itself.

As an alternative to this solution, the support structure 18 may be formed in two parts connected by a resilient member arranged to provide the functions described above.

Figure 2:
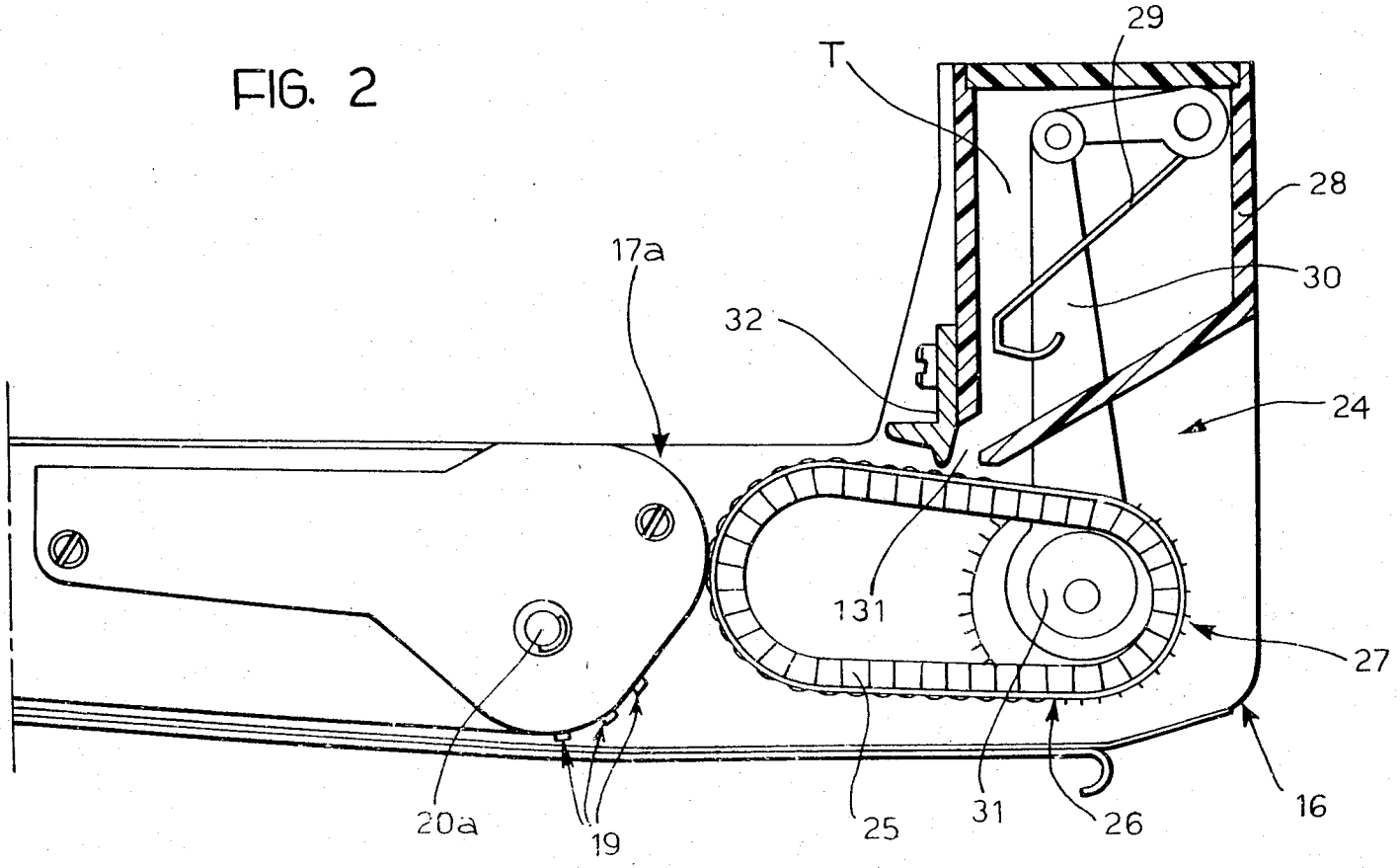
FIG. 2 illustrates on an enlarged scale, one of the elements illustrated in FIG. 1, and FIGS. 3 and 4 illustrate, on an enlarged scale, two possible embodiments of another of the elements illustrated in FIG. 1.

A developing device, generally indicated 24 and best seen in FIG. 2, is constituted by a magnetic belt 25 of tubular form that is encompassed by a sleeve 26 of non-magnetic material.

In an arrangement entirely analogous to that described with reference to the driving of the photosensitive band 17 by the sprockets 20, the sleeve 26 is rotated in an anti-clockwise sense about the belt 25 by a pair of drive sprockets 27.

The belt 25 is made of an externally-metallized rigid material as plastoferrite and is magnetized, in known manner, so as to provide a regular distribution of magnetic dipoles each of which has a polarisation that is opposite to that of the adjacent one dipole.

The sleeve 26 is constituted by a thin strip of non-magnetic metal or metallized plastics in order to enable it to be connected to earth or to a polarisation source of the developing device 24.

The assembled arrangement of the developing device 24 on the container 16 is such that the belt 25, with the sleeve 26 extending there around, is in a position such that the sleeve 26 is substantially tangential to the photosensitive band 17.

Reference 28 indicates a reservoir which contains a toner T such as, for example, a single-component, conductive or resistive magnetic toner or a toner which can be applied by "jumping system". As an alternative, a bicomponent may be used.

Within the reservoir 28 is a mixing member 29 which is moved by a lever transmission 30 actuated by an eccentric 31 rotated by one or both the sprockets 27.

The mixing member 29 is intended to prevent the formation of lumps in the toner.

The reservoir 28 is an integral part of the container 16 and can be sealed after it has been filled with toner.

The reservoir 28 is located above the developing device 24 and is provided with a supply aperture 131 through which the toner falls onto the sleeve 26 located around the belt 25 and is entrained thereby due to the magnetic force emanating from the magnetic belt.

Reference 32 indicates a levelling blade for regulating the thickness of the layer of toner transferred to the sleeve 26.

Reference 33 indicates a shaped roller for enabling the removal of sheets P from the cassette 22. The roller 33 urges each sheet removed from the cassette 22 towards a pair of contra-rotating rollers 34 which draw the sheet into alignment with a reference register 35 positioned by a relay 36.

Reference 37 indicates a transfer corona discharge source located adjacent the profiled end 23 of the support structure 18. The source 37 is intended to act on the sheets P which are advanced into contact with the photosensitive band 17 by the rollers 34, these sheets being subsequently fed through a fixing device 38 (the structure of which will be more fully described below) towards a pair of expulsion rollers 39 which expel the sheet P from the machine 1. Reference 40 indicates a further light source that is substantially the same as the source 12 and acts on the band 17 in a position downstream of the charge source 37 in the direction of movement of the band 17 itself around the structure 18.

Figure 3:
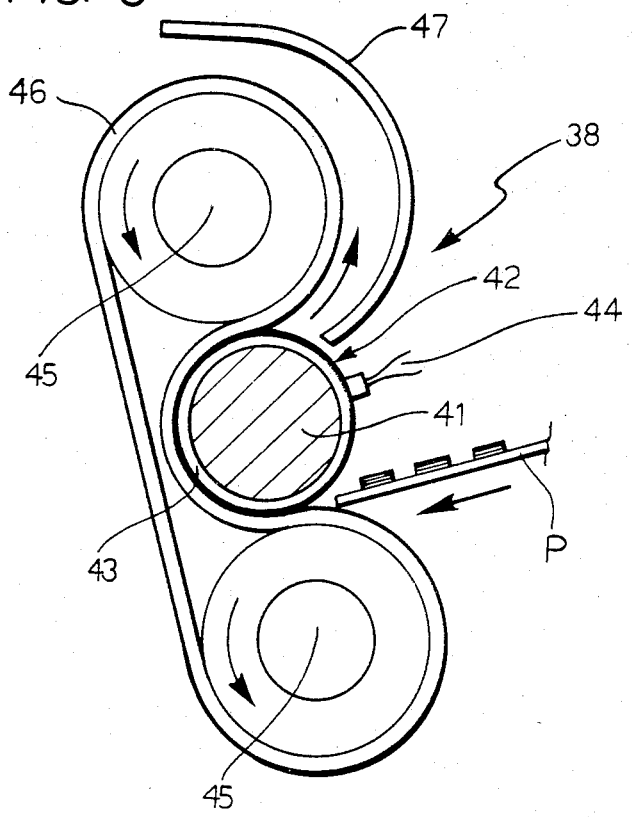

With reference to the embodiment of the fixing device 38 illustrated in FIG. 3, a cylindrical roller referenced 41 has its axis of rotation parallel to the axes of rotation of the rollers 34 and the expulsion rollers 39.

The roller 41 is made of thermally conductive material such as aluminium, brass or steel and has dimensions such as to give it a small thermal inertia.

The roller 41 has an outer coating constituted by a film 42 of electrically resistive material.

The resistive film 42 which may be continuous or have a helical configuration is connectable by sliding contacts to an electrical supply so as to result in heating of the outer surface of the roller 41. Between the metal core of the roller 41 and the resistive coating 42 there is normally a layer of thermally insulating material 43 of ceramics or plastics.

The temperature reached by the surface of the roller 41 is monitored by a thermo-couple 44 which enables the supply to the resistive layer 42 to be controlled to keep the temperature at a predetermined level.

Two further rollers 45 of heat-resistant rubber or plastics material are disposed on opposite sides of the roller 43 substantially tangential to the roller 43 itself.

A heat-resistant rubber belt 46 is connected between the rollers 45 with its outer face wrapped around the roller 43 through an angular extent substantially corresponding to half the overall angular extent of the roller 43 itself.

The arrangement is such that the rollers 44 and 45 together with the belt 46 define a tortuous path for the advance of the sheets P between the zone of contact with the photosensitive band 17 and the expulsion rollers 39.

The correct orientation of the sheets P relative to these expulsion rollers 39 is ensured by a shaped covering element 47 that curves around the roller 45 located downstream of the "hot" roller 41 in the direction of movement of the sheets P through the fixing device 38.

Figure 4:
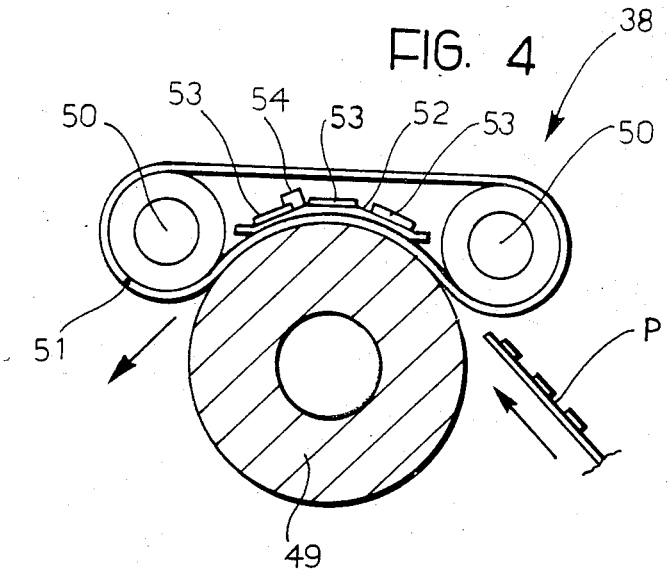

With reference to the embodiment of the fixing device 38 illustrated in FIG. 4, references 49 and 50 indicate three rollers defining a configuration substantially identical to the configuration defined by the rollers 41 and 45 in FIG. 3.

More particularly, the roller 49 occupying the intermediate position is a roller provided with a heat-resistant rubber or plastics coating arranged to impart a certain surface compliance to the roller itself.

The two rollers 50 lying on opposite sides of the roller 49 are interconnected by a heat-resistant plastics or metal belt 51 of small thickness.

The rollers 50 which may be formed entirely of metal or have a surface coating of heat resistant rubber or plastics, circulate the belt 51 such that sheets P fed to the fixing device 38 are drawn between the belt 51 and the roller 49.

A shoe 52 of metal or other thermally conductive material is located within the belt 51 and has a shape corresponding to the shape of the pass of the belt 51 which presses the sheets P against the roller 49. On the face of the shoe 52 opposite the roller 49 is a layer of insulating material to which electrical resistors 53 (three in the embodiment illustrated) are attached that can be connected to an electrical supply in order to heat the shoe 52.

The temperature to which the shoe 52 is heated can be controlled through a thermo-couple 54.

The resistances 53 may be supplied simultaneously and identically to each other or separately in a selective supply scheme for causing a predetermined temperature distribution on the surface of the shoe 52.

In both embodiments illustrated in FIGS. 3 and 4, the preferred assembly arrangement of the fixing device 38 is that whereby the surface of the sheets P previously brought into contact with the photosensitive band 17 faces the heating elements (roller 41 of FIG. 3, shoe 52 of FIG. 4).

The operation of the machine according to the invention starts from a condition in which the scanning device 8 is located in its starting position A.

At the beginning of an operating cycle, the motor which rotates the pulley 7 is activated so as to cause the device 8 to effect scanning of the reading plane 3 moving from its initial position A to the final position B.

During this scanning movement the lamp 12 is energised. The original O on the reading plane 3 is thus illuminated by light from the cavity 10 which at any instant lights a transverse strip of the original O.

The radiation reflected from the original O is collected by the linear fibre optic objective 14 which projects this radiation onto the photo-conductive layer **17*a* of the upper pass of the photosensitive band 17**.

The portion of the photosensitive layer **17*a* exposed at any instant to the reflected radiation corresponds soley to the transverse strip framed by the fibre optic objective 14 since the protective blinds 15 prevent this radiation from reaching any other region of the band 17**.

As a result of this exposure to light, a spatial charge distribution is created in known manner in the photoconductive layer that reproduces the features of the original O.

When the scanning device 8 reaches its end of stroke position B, the light source 12 is de-energised and the sense of rotation of the motor driving the pulley 7 is reversed so as to return the device 8 to its initial position A.

Simultaneously the photosensitive band 17 is moved around on the support structure 18 by means of the sprockets 20 so as to bring the pass previously facing the cassette 22 onto the upper face of the structure 18.

The sprockets 27 which circulate the sleeve of non magnetic material 26 about the magnetic belt 25 are rotated simultaneously with the sprockets 20 and at the same tangential velocity.

Thus the toner in the reservoir 28 is deposited in the form of a thin layer on the outer face of the pass of the sleeve 26 overlying the belt 25. The depth of this layer is regulated by the position of the blade 32.

As a result of the co-ordinated movement of the photosensitive band 17 and the sleeve 26, the toner is deposited on the photo-conductive layer **17*a* in a spatial distribution which reproduces the spatial distribution of charge present on the photo-conductive layer 17*a*. In this manner, an image of the original O is formed on the photosensitive layer 17***a*.

The operation of forming this image finishes on the complete transport onto the lower face of the structure 18 of the pass of the band 17 which was previously on the upper face of the structure 18.

Once this last condition is achieved, the rollers 34 carry one of the sheets P taken from the cassette 22 beyond the alignment register 35 and towards the region between the profiled end 23 of the support structure 18 and the corona source 37.

The portion of the sheet P which is instantaneously within this region is charged electrostatically by the corona source 37 so that the toner which forms the image of the original O on the photo-conductive layer 17*a* is transferred on the upper face of the sheet P.

As the sheet P moves beyond the region of contact with the photo-sensitive band 17, it is introduced into the fixing device 38 in order to bring about fusion of the toner and its permanent adhesion to the sheet P.

In the case in which the fixing device illustrated in FIG. 3 is used, the layer of toner present on the sheet P, schematically indicated by a series of black lines, comes into contact with the resistive heating layer 43 deposited on the outer surface of the roller 41.

In the fixing device illustrated in FIG. 4, the fusion of the toner is however achieved by bringing the layer of toner into contact with the outer face of the belt 51 which is heated by the resistive elements 53 mounted on the shoe 52.

In both embodiments, the low thermal inertia of the roller 41 and the shoe 52 allows the heating elements associated therewith to be activated only when one of the sheets P passes through the fixing device 38. This reduces the use of power by the device and also facilitates the dissapation of the heat generated thereby. It is also possible to keep the operating temperature of the heating elements at a low level, slightly higher than the temperature of softening of the toner, since this reduction in temperature may be compensated for by an increase in the time during which the toner is kept in contact with the heating elements themselves.

As indicated above, the configuration of the heating elements of the device of FIG. 4 also allows variation of the strength of the overall heating supplied by the heating elements.

The low thermal inertia of the heating elements, the low dissipation to the exterior (in both embodiments illustrated, the heating elements are almost completely surrounded by a heat-insulating belt), and the low working temperature also contribute to a reduction in the warm-up time compared with typical times for fixing devices at present in use.

The sheet P carrying the toner permanently affixed to one of its faces is the final product of the reproduction operation. The expulsion of the sheet from the machine 1 is achieved by means of the pair of rollers 39.

As a result of its translational movement around the structure 18 during transfer of the toner to the sheet P, the photosensitive band 17 passes in front of the light source 40 which illuminates the photo-conductive layer 17*a* uniformly, thus generating in a known manner a uniform discharge of the residual electrostatic charges thereon. In this manner, the band 17 is charge wiped cleared and made susceptible to subsequent exposures in a new scanning cycle of an original O by means of the device 8 in the manner described above.

The arrangement of the photosensitive band 17 and the shape of the support structure 18 are such that, when one of the passes of the band 17 is transferred to the lower face of the structure 18 after being "exposed" by the scanning device 8, a further pass of the band, having identical dimensions, is advanced to the upper face of the same structure 18 and can be scanned by the device 8 to form a further latent image of the original O or of another original substituted therefor on the reading plane 3.

Two frames are thus available on the band 17 which can be exposed and be developed successively from each other in a continuous reproduction cycle.

This cycle may be effected either by advancing the band 17 in successive steps each of which results in an advance of the band through half its overall length, or by an operating cycle in which each of these steps results in an advance of the band equal to one and a half times its overall length.

In the first case the movement of the band 17 is interrupted at the end of each development operation by the toner on one of the frames of the photo-conductive layer 17*a*.

When the second solution is opted for, the movement of the band is interrupted only to allow the exposure of each frame by the scanning device 8.

The choice of one or other solution is made in dependence on the time required by the device 8 to travel the scanning path from position A to position B and the time needed to achieve the advance of a bass of the photosensitive band 17 from the upper face to the lower face of the support structure 18. Naturally, the principle of the invention remaining the same, the constructional details and the embodiments may be varied widely without thereby departing from the scope of the present invention.

We claim:

1. A reproduction machine to reproduce an original on a substrate, comprising:

a structural housing, means in said housing for supporting said original, a scanning device for optically scanning said original, a process unit including a photoconductive member, a toner supply means and a developing device, said process unit being conditioned by said scanning device for forming a latent image of said original on said photoconductive member, said developing device carrying the toner supplied by said supplying means to develop said latent image, wherein the improvement includes a cartridge for supporting said process unit including a support structure for supporting said photoconductive member in a closed loop arrangement therearound, having a substantially flattened form and upper and lower faces rigidly connected to and parallel to each other and to said original, said photoconductive member forming over said upper face a planar surface on which said latent image is formed, said structure also comprising drive means for advancing said member at one end of said flattened structure and a resilient channel-shaped portion integral with the structure and placed opposite with respect to said driving means to tension said member around said structure and means for removably mounting said cartridge in said housing together with said process unit so that it can be replaced when said supply means has exhausted the toner.

2. A reproduction machine according to claim 1, wherein said developing means comprises a magnetic member of elongated tubular form encompassed by a sleeve of non-magnetic material, said magnetic member being made of a plurality of adjacent rigid magnetizable blocks so magnetized as to form a plurality of magnetic dipoles of opposite polarity located at constant mutual distance, said magnetic blocks being fixed on said cartridge, sprocket means carried by said support structure for advancing said sleeve externally around the member, said sleeve being substantially tangential to said photoconductive member at said one end.

3. A reproduction machine according to claim 2 wherein said photoconductive member and said sleeve are advanced at the same peripheral speed to carry out the development of said latent image onto said photoconductive member.

* * * * *